US008757182B2

(12) United States Patent
Schmon

(10) Patent No.: US 8,757,182 B2
(45) Date of Patent: Jun. 24, 2014

(54) CLEANING DEVICE FOR CLEANING SPRAY GUNS

(75) Inventor: Ewald Schmon, Grafenberg (DE)

(73) Assignee: Sata GmbH & Co. KG, Kornwestheim (DE)

( * ) Notice: Subject to any disclaimer, the term of this patent is extended or adjusted under 35 U.S.C. 154(b) by 630 days.

(21) Appl. No.: 12/595,062

(22) PCT Filed: Oct. 6, 2008

(86) PCT No.: PCT/EP2008/063344

§ 371 (c)(1),
(2), (4) Date: Dec. 17, 2009

(87) PCT Pub. No.: WO2009/056424

PCT Pub. Date: May 7, 2009

(65) Prior Publication Data

US 2010/0126541 A1 May 27, 2010

(30) Foreign Application Priority Data

Oct. 30, 2007 (DE) ..... 10 2007 052 067

(51) Int. Cl.

| | |
|---|---|
| ***B08B 3/12*** | (2006.01) |
| ***B08B 6/00*** | (2006.01) |
| ***B05B 7/24*** | (2006.01) |
| ***B08B 1/00*** | (2006.01) |
| *B05B 15/02* | (2006.01) |

(52) U.S. Cl.

CPC ..... *B05B 15/0208* (2013.01); *B05B 7/2478* (2013.01); *B05B 15/0258* (2013.01); *B05B 15/0266* (2013.01); *B05B 15/025* (2013.01); *B08B 1/00* (2013.01)

USPC ..... 134/198

(58) Field of Classification Search
None
See application file for complete search history.

(56) References Cited

U.S. PATENT DOCUMENTS 4,964,361 A 10/1990 Aebersold
5,704,381 A 1/1998 Millan et al.

(Continued)

FOREIGN PATENT DOCUMENTS

CH 676208 A5 12/1990
DE 20000483 U1 6/2000

(Continued)

OTHER PUBLICATIONS

International Search Report published May 7, 2009 for PCT/EP2008/063344, filed Oct. 6, 2008.

(Continued)

*Primary Examiner* — Jason Ko

(74) *Attorney, Agent, or Firm* — Fleit Gibbons Gutman Bongini & Bianco PL; Martin Fleit; Paul D. Bianco

(57) ABSTRACT

The invention relates to a cleaning device for cleaning spray guns, particularly paint spray guns, having at least one cleaning nozzle connected to a transport device for cleaning fluid, and having a frictional cleaning device for manually cleaning the spray guns or parts thereof. Known cleaning devices of such a type can only insufficiently clean the paint spray channel. The object of providing a cleaning device by means of which parts of both the outer surface and the paint spray channel can be efficiently and environmentally soundly cleaned is achieved in that the cleaning nozzle is disposed near and above the frictional cleaning device, so that cleaning fluid can be sprayed through the cleaning nozzle into and/or on the spray gun, and the spray gun, and particularly the spray gun nozzle, can be simultaneously manually cleaned by friction using the frictional cleaning device.

18 Claims, 2 Drawing Sheets

(56) References Cited

U.S. PATENT DOCUMENTS

| | | | | |
|---|---|---|---|---|
| 6,554,009 | B1 | 4/2003 | Beijom et al. | |
| 6,647,997 | B2 | 11/2003 | Mohn | |
| 7,533,678 | B2 | 5/2009 | Rosa | |
| 2002/0170978 | A1 | 11/2002 | Mohn | |
| 2005/0268949 | A1 | 12/2005 | Rosa | |
| 2006/0048803 | A1 * | 3/2006 | Jessup et al. | 134/198 |

FOREIGN PATENT DOCUMENTS

| | | | |
|---|---|---|---|
| DE | 20114257 | U1 | 2/2002 |
| DE | 602005001173 | T2 | 8/2007 |
| EP | 1574262 | A1 | 9/2005 |
| EP | 1602412 | A1 | 12/2005 |
| WO | 0218061 | A1 | 3/2002 |

OTHER PUBLICATIONS

International Preliminary Report on Patentability published on Jun. 1, 2010 for PCT/EP2008/063344, filed Oct. 6, 2008.

Written Opinion published on Jun. 1, 2010 for PCT/EP2008/063344, filed Oct. 6, 2008.

* cited by examiner

CLEANING DEVICE FOR CLEANING SPRAY GUNS

FIELD OF THE INVENTION

The invention relates to a cleaning device for cleaning spray guns.

BACKGROUND OF THE INVENTION

The cleaning device according to the invention is used for quick manual cleaning of spray guns, particularly paint spray guns. During painting processes, changing paint is often necessary. So that no residue from the previous paint or lacquer remains in the spray gun, it is necessary to clean the spray gun when changing paints. In particular, this quick cleaning when changing paints may be performed with the cleaning device according to the invention. After the completion of the painting process, the spray gun is preferably subjected to an intense, full cleaning process that is typically performed in a cleaning machine. Such cleaning machines for the automated intense cleaning of spray guns are known from the state of the art, for example, from DE 201 14 257 U1, WO 02/18061 A1, and EP 1602412 A1.

From DE 201 14 257 U1, a cleaning device for paint spraying devices such as, e.g., paint spray guns, is known that provides a housing for holding the paint spraying devices, wherein the housing has cleaning nozzles and the cleaning nozzles are connected by a hose to a pneumatically operating feed device. The feed device is connected to two containers for holding, respectively, clean and contaminated cleaning fluid. The housing contains a nozzle holder on which the paint spray gun to be cleaned can be placed. For cleaning the paint spray gun, a cleaning fluid that typically contains a solvent is sprayed through nozzles into the paint spray channel of the paint spray gun to free the paint spray channel of paint or lacquer residue. In addition to cleaning the paint spray channel, the spray gun is also cleaned from the outside whereby cleaning fluid is sprayed onto the spray gun via the nozzles. Furthermore, in the cleaning device known from DE 201 14 257 U1, a cleaning brush is provided that is connected by a hose to a pump. This brush is used for manual cleaning of the spray gun, wherein the supply of cleaning fluid to the cleaning nozzles is stopped while cleaning fluid is fed to the cleaning brush. With this cleaning device, the spray gun can be cleaned either automatically or manually with the cleaning brush. In the case of manual cleaning of the spray gun by means of the cleaning brush, however, merely the outer surface of the spray gun is cleaned. The paint spray channel cannot be cleaned in this way.

From EP 1602412 A1, a cleaning device according to the class is similarly known for spray guns in which, for the manual cleaning of the spray gun, a cleaning brush attached to a hose is provided. Also in this known device, only a manual cleaning of the outer surface of the spray gun is performed. Simultaneous cleaning of the paint spray channel of the spray gun cannot be performed in this way.

SUMMARY OF THE INVENTION

Therefore, the invention is based on the problem of disclosing a cleaning device for the manual cleaning of spray guns, whereby both parts of the outer surface, in particular, the air nozzle of the spray gun, and also the spray channel in the interior of the spray gun body can be cleaned in the most efficient and environmentally friendly way possible.

This problem is solved with a cleaning device described herein. Preferred embodiments of this cleaning device are also described herein.

BRIEF DESCRIPTION OF THE DRAWINGS

The invention will be explained below in greater detail using an embodiment with reference to the accompanying drawings. The drawings show.

DETAILED DESCRIPTION OF THE INVENTION

Figure 1:
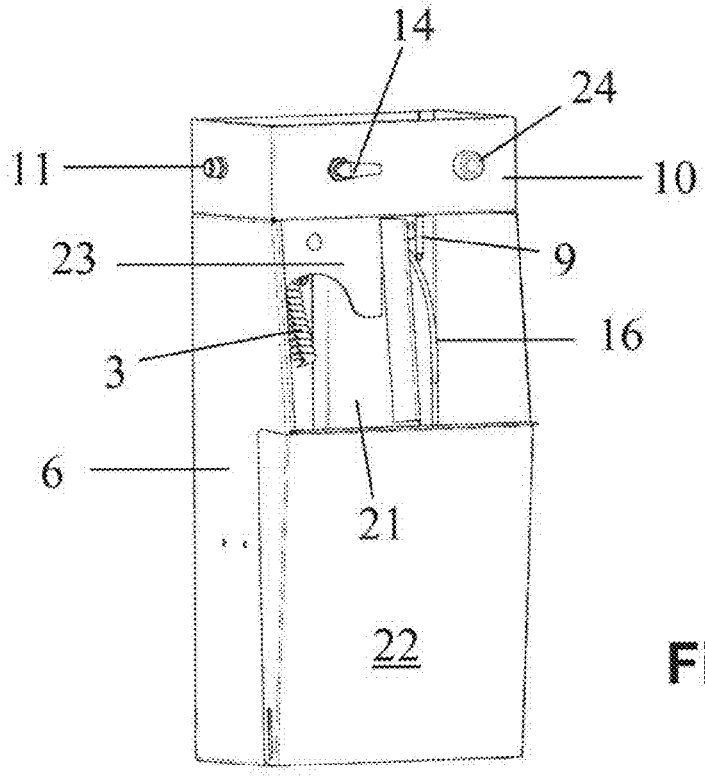
FIG. 1: perspective diagram of a cleaning device according to the invention for a closed housing cover.
Figure 2:
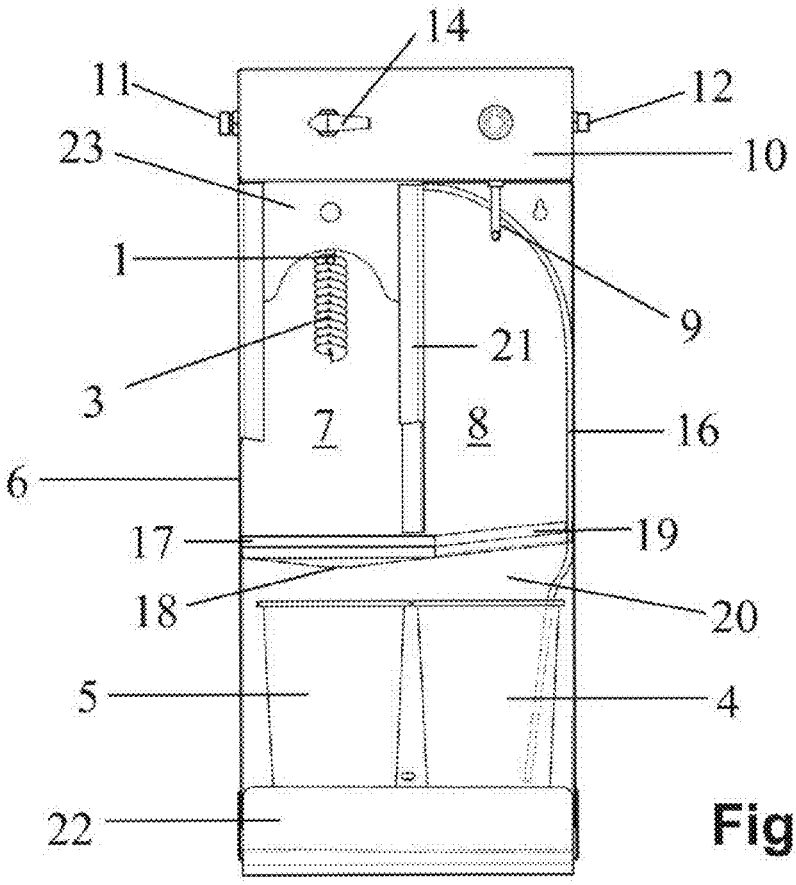
FIG. 2: front view of the cleaning device of FIG. 1 for an opened housing cover.

The cleaning device shown in FIGS. 1 and 2 has a housing 6 that is preferably made from metal, in particular, from stainless steel sheet metal. On the top side of the housing 6 there is a control device 10 that is shown in detail in FIG. 4 and that is described in greater detail below. In the interior, the housing 6 has three chambers, namely a first upper chamber 7 and a second upper chamber 8 that are separated from each other by an intermediate wall 21. Underneath the first chamber 7 and the second chamber 8 is a third chamber 20, wherein the two upper chambers 7, 8 are separated from the lower chamber 20 by a floor 17 of the first chamber 7 and a floor 19 of the second chamber 8. The first chamber 7 is used for the manual cleaning of a spray gun with a cleaning fluid. The cleaned spray gun can be dried in the second chamber 8. The lower chamber 20 contains two containers 4, 5, where the first container 4 is used for holding clean cleaning fluid. The cleaning fluid used during the cleaning process collects in the second container 5, so that it can be fed to a recovery unit and, if necessary, to a preparation unit. In order to collect the cleaning fluid flowing downward during the cleaning process and also dripping down during the drying process, the floors 17, 19 of the two upper chambers 7, 8 have a tank-like construction and an outlet 18 is provided in the floor 17, whereby the cleaning fluid collected in the tank-shaped floors 17, 19 can flow through this outlet into the collection container 5 arranged underneath. The lower chamber 20 can be closed by a housing cover 22 hinged on the housing 6 so that it can pivot.

Figure 4:
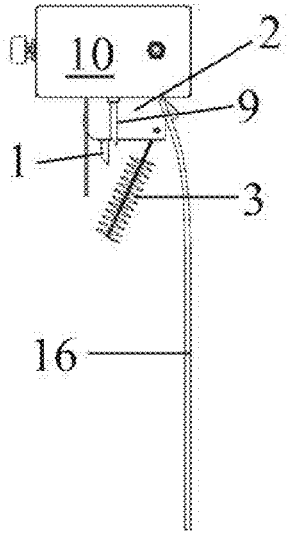
FIG. 4: side view of the cleaning unit of the cleaning device of FIG. 1, FIG. 5: diagram of the control device of the cleaning device of FIG. 1 in a top view for an opened cover of the control device housing.

The upper region of the first chamber 7 contains a cleaning nozzle 1 that is formed by a hose section of a plastic hose and that is connected to a feed device 2. The feed device 2 comprises a pump, in particular, an injector pump acting as a water jet pump that draws cleaning fluid via an intake hose 16 from the storage container 4 and feeds it to the cleaning nozzle 1. Within the housing 6 is a friction cleaning device 3 arranged stationary beneath the cleaning nozzle 1, where, in the embodiment shown here as an illustration, this friction cleaning device is formed by a cylindrical cleaning scrubber. The friction cleaning device 3 could also involve a cleaning brush or a cleaning sponge. The cleaning brush is arranged extending at an angle with respect to the longitudinal axis of the cleaning nozzle underneath the opening of the cleaning nozzle 1. Preferably, the cleaning brush is arranged so that, with the longitudinal axis of the cleaning nozzle 1, its longitudinal axis encloses an angle of 30° to 60°, preferably 45°, as can be seen from FIG. 4. Preferably, the cleaning brush is indeed installed stationary in the housing 6, but its position and orientation with respect to the opening of the cleaning nozzle 1 is preferably adjustable, wherein either the hose section forming the cleaning nozzle 1 can be pulled out from or pushed into the housing part to which the cleaning nozzle 1 is fastened and/or wherein the cleaning brush is hinged on the housing part so that it can pivot (FIG. 4). Preferably, the cleaning brush has a flexible or elastic construction. The cleaning brush may be mounted elastically on the housing part, in particular, against a restoring force. A spray protection device 23 is arranged in front of the cleaning nozzle 1 and the cleaning brush 3.

Figure 3:
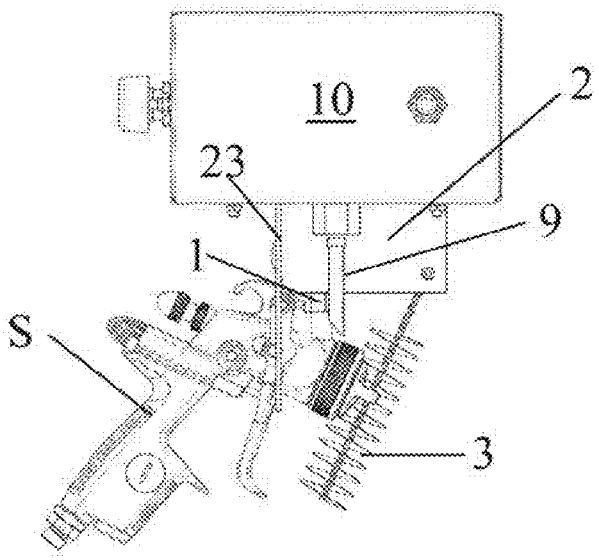
FIG. 3: detailed diagram of the cleaning unit of the cleaning device of FIG. 1 in a side view and with a spray gun to be cleaned.
Figure 5:
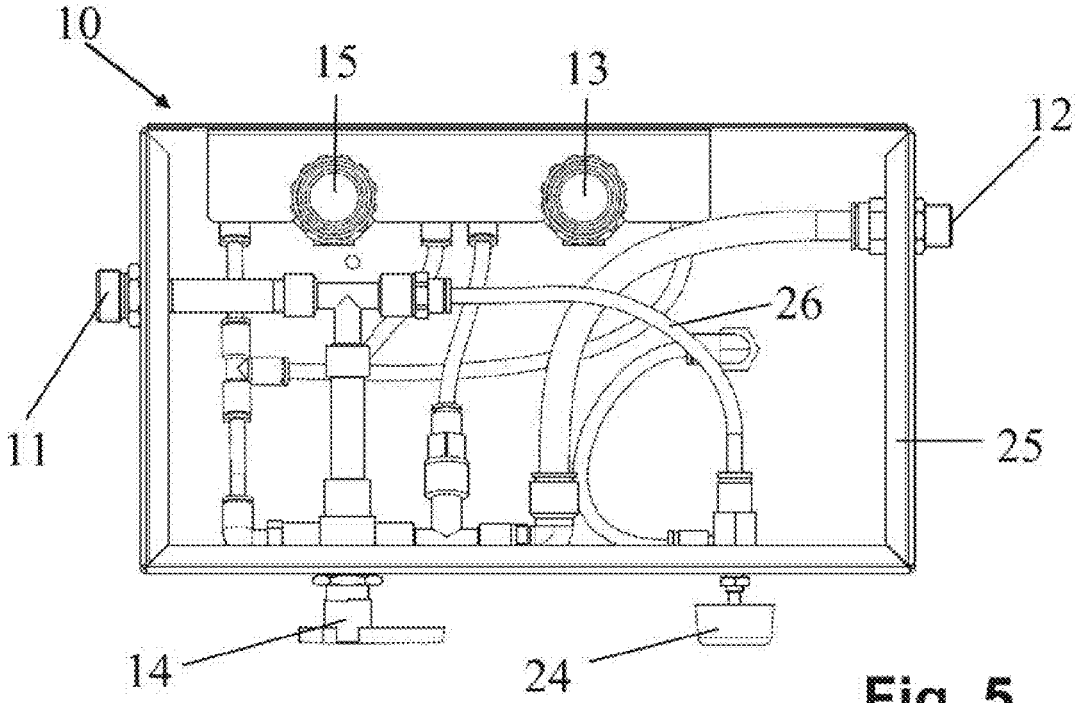

In the second chamber 8 there is a drying nozzle 9 that can be charged with drying air and that is formed, like the cleaning nozzle 1, by a hose section of a plastic hose. Above the two chambers 7, 8 there is a control device 10 with which the functions of the cleaning device can be controlled. The control device 10 shown in detail in FIG. 5 in a view from above (for an opened housing cover) has a parallelepiped housing 25 that is closed by a cover not shown in FIG. 5. In the side parts of the housing there are connection ports for a compressed-air inlet 11 and a compressed-air outlet 12. The compressed-air inlet 11 is connected to a compressor. At the compressed-air outlet 12, the spray gun is charged with compressed air via a compressed-air line, wherein one end of the compressed-air line is connected to the compressed-air outlet 12 and the other end is connected to the compressed-air inlet of the spray gun. In the interior of the housing 25 of the control device 10 there is a pressure reducer 13 with which the air pressure applied to the spray gun S is regulated. For regulating the air pressure applied to the spray gun, a selection switch 14 is provided on the front side of the housing 25. With this selection switch 14, the function could be selected between a cleaning function and a spraying function. In the spraying function, the full air pressure at the compressed-air inlet 11 is provided to the compressed-air outlet 12 and thus to the connected spray gun. In this function position, the connected spray gun S can be used for spraying liquid, in particular, for conventional painting. For quick manual cleaning of the spray gun, the cleaning device function is switched by means of the selection switch 14 to the cleaning function. In the cleaning function, the air pressure at the compressed-air outlet 12 is throttled by the pressure reducer 13 relative to the air pressure at the compressed-air inlet 11. Simultaneously, in the cleaning function, cleaning fluid is fed by the feed device 2 from the storage container 4 into the spray nozzle 1. For the manual cleaning of the spray gun, when the cleaning function is set on the cleaning device, the spray gun is loaded into the first chamber 7 and arranged there so that the cleaning fluid flowing out from the cleaning nozzle 1 can flow into the spray channel, in particular, into the paint inlet channel of the spray gun, as shown in FIG. 3. For this purpose, the spray gun S is arranged, as shown in FIG. 3, underneath the opening of the cleaning nozzle 1 and the hose end of the cleaning nozzle 1 is placed into the paint inlet channel of the spray gun S. In this position, the front side of the spray gun where the removable air nozzle is arranged touches the cleaning brush 3. For cleaning the front part of the spray gun S, that is, the air nozzle in particular, the spray gun moves manually up and down and/or back and forth, so that the surface, in particular, of the removable air nozzle rubs against the cleaning brush 3. In this way, lacquer residue is removed from the surface of the spray gun through friction. In this way, the spray gun S is cleaned during the cleaning process both on the outside and also in the interior, that is, in the spray channel.

To enable the most efficient possible cleaning of the spray channel that uses as little cleaning agent as possible, a cleaning agent/air mixture is preferably discharged from the cleaning nozzle 1 into the spray channel of the spray gun S. Here, compressed air is fed to the feed device 2, wherein this compressed air mixes with the cleaning fluid from the storage container 4. Here, the feed device 2 preferably has an injector pump constructed as a water jet pump that is connected to the compressed-air inlet 11 via a pressure reducer 15 arranged in the housing 25 of the control device. This water jet pump operated by the compressed air from the compressed-air inlet 11 feeds cleaning fluid via the intake hose 16 from the storage container 4 and simultaneously mixes said fluid with the compressed air, thus generating the cleaning agent/air mixture with which the cleaning nozzle 1 is charged in the cleaning function of the device.

After successful cleaning of the spray gun, it is removed from the first chamber 7 and fed into the second chamber 8. In the second chamber 8, the cleaned spray gun is dried by means of the blow-drying nozzle 9, wherein the spray gun S is held in the air stream of the blow-drying nozzle 9. For activating the blow-drying nozzle 9, an activation button 24 is provided that, when activated, allows compressed air to flow from the compressed-air inlet 11 via a bypass channel 26 into the blow-drying nozzle 9. During the blow-drying of the spray gun, residue of the cleaning fluid is removed from the surface of the spray gun and also from the spray channel. The drops of cleaning fluid dripping from the spray gun S are collected in the tank-shaped floor 19 of the second chamber 8. The floor 19 of the chamber 8 is inclined relative to the floor 17 of the opposing chamber 7, so that the fluid residue collecting in the floor 19 can flow onto the floor 17 and through the outlet 18 into the collection container 5.

After completion of the cleaning and drying processes, the spray gun S is removed from the second chamber 8 again and the cleaning device is set to the spraying function by meaning the selection switch 14. In the spraying function, the manually cleaned spray gun S can then be used again for spraying fluids, in particular, for painting. When the cleaning device is switched from the cleaning function to the spraying function, the cleaning agent feed to the cleaning nozzle 1 is closed and simultaneously the full air pressure available on the compressed-air inlet 11 is applied to the compressed-air outlet 12.

To simplify cleaning, repair, and maintenance work on the cleaning device, the control device 10 can be removed from the housing 6. Therefore, for repair or maintenance work, the control device 10 that is preferably fastened to the wall can be removed from the housing 6. The housing 25 of the control device 10 is covered with a housing cover, wherein the housing cover preferably has walls projecting upward on the edges. The cover of the housing 25 could therefore be used as a storage surface for spraying-device accessories, for example, for paint cans. Another storage surface for spraying devices or accessories is formed by the flap 22 that is hinged on the housing 6 so that it can pivot and on which, in the opened position (FIG. 2), such parts or also the containers 4, 5 can be stored when changing containers.

An embodiment not shown diagrammatically provides the collection container 5 with a cover for closing the container, wherein the cover has a flange for connecting to the outlet 18. In this embodiment it is guaranteed that the cleaning fluid collected on the tank-shaped floor 17 and that flows through the outlet 18 can flow directly into the collection container 5. An alternative to this embodiment can also be provided wherein a hose is flanged onto the outlet 18, wherein this hose leads the cleaning fluid flowing out into a large collection tank that can be arranged under the cleaning device or next to the cleaning device.

The invention claimed is:

1. A cleaning device for cleaning a spray gun, the cleaning device comprising:

a feed device having an input connectable to a supply of cleaning fluid, and an output;

at least one cleaning nozzle connected to the output of the feed device;

a friction cleaning device configured for cleaning the spray gun or at least a part of the spray gun, the cleaning nozzle located proximate the friction cleaning device such that the cleaning nozzle applies cleaning fluid to the spray gun as the spray gun is cleaned by the friction cleaning device;

a control device configured for controlling function of the cleaning device; the control device having:

a connection port inlet configured for connection to a source of compressed air;

a connection port outlet configured for connection with a compressed-air inlet of the spray gun, the connection port outlet admitting pressurized air into the compressed-air inlet of the spray gun during cleaning of the spray gun; and a pressure regulator for regulating air pressure of the pressurized air applied to the compressed-air inlet of the spray gun wherein the control device further comprises a selection switch for switching the cleaning device between a cleaning function and a spraying function, wherein in the spraying function the full air pressure of the compressed air is applied through the connection port outlet into the compressed-air inlet of the spray gun and in the cleaning function the air pressure of the compressed air applied into the compressed-air inlet of the spray gun is reduced by the pressure regulator.

2. The cleaning device according to claim 1, further comprising a first container for holding a supply of cleaning fluid and a second container for holding used cleaning fluid, wherein the feed device takes cleaning fluid from the first container and feeds it to the cleaning nozzle.

3. The cleaning device according to claim 1, further comprising a housing, the housing open on one side and having an interior including a first chamber for cleaning of the spray gun and a second chamber for drying the spray gun after the spray gun is cleaned.

4. The cleaning device according to claim 3, further comprising at least one blow-drying nozzle connected to a source of compressed air and positioned in the second chamber.

5. The cleaning device according to claim 1, wherein the cleaning process is started automatically when the selection switch is switched to the cleaning function and cleaning fluid is fed by the feed device through the cleaning nozzle.

6. The cleaning device according to claim 1, wherein the feed device further includes a pump that charges the cleaning nozzle with a cleaning fluid during cleaning of the spray gun.

7. The cleaning device according to claim 6, wherein the pump is selected from the group consisting of an injector pump and a water jet pump, and is driven by pressurized air.

8. The cleaning device according to claim 7, wherein the feed device further includes an intake hose through which the pump pumps cleaning fluid.

9. The cleaning device according to claim 1, wherein the friction cleaning device is selected from the group consisting of a cleaning scrubber, a cleaning brush, and a cleaning sponge.

10. The cleaning device according to claim 9, wherein the friction cleaning device is a cleaning brush arranged at an angle with respect to a longitudinal axis of the cleaning nozzle.

11. The cleaning device according to claim 10, wherein an inclination of the cleaning brush with respect to the cleaning nozzle is adjustable.

12. The cleaning device according to claim 3, wherein the first chamber includes a collection tank having an outlet, wherein cleaning fluid that drips into the collection tank can flow through the outlet into the second container underneath the collection tank.

13. The cleaning device according to claim 12, wherein the second chamber includes a collection tank connected to the collection tank of the first chamber and is positioned at an incline relative to the collection tank of the first chamber, so that cleaning fluid dripping into the collection tank of the second chamber can flow into the outlet in the collection tank of the first chamber.

14. The cleaning device according to claim 1, wherein the spray gun is a spray gun for paint.

15. The cleaning device of claim 1, wherein the cleaning nozzle is configured for connection to inlet for spray material of the spray gun.

16. A cleaning device for cleaning a spray gun having an inlet for compressed air, an inlet for spray material, and an outlet for spray material, the cleaning device comprising:

a pump having an input connectable to a supply of cleaning fluid, and an output forming a cleaning nozzle for applying cleaning fluid to the spray gun;

a friction cleaning device configured for contacting a surface of the spray gun when the cleaning nozzle is applying cleaning fluid to the spray gun; and a control device configured for controlling function of the cleaning device, the control device having:

a connection port inlet configured for connection to a source of compressed air;

a connection port outlet configured for connection with the inlet for compressed air of the spray gun, the connection port outlet admitting pressurized air into the inlet for compressed air of the spray gun; and a pressure regulator for regulating air pressure of the pressurized air applied to the inlet for compressed air of the spray gun wherein the control device further comprises a selection switch for switching the cleaning device between a cleaning function and a spraying function, wherein in the spraying function the full air pressure of the compressed air is applied through the connection port outlet into the compressed-air inlet of the spray gun and in the cleaning function the air pressure of the compressed air applied into the compressed-air inlet of the spray gun is reduced by the pressure regulator.

17. A cleaning device for cleaning a spray gun, the cleaning device comprising:

a feed device having an input connectable to a supply of cleaning fluid, and an output;

at least one cleaning nozzle connected to the output of the feed device;

a friction cleaning device configured for cleaning at least a part of the spray gun, the cleaning nozzle located proximate the friction cleaning device, wherein the cleaning nozzle applies cleaning fluid to the spray gun as the spray gun is cleaned by the friction cleaning device; and a control device configured for controlling function of the cleaning device and positioned at a top portion of a housing; the control device having:

a pressure regulator for regulating air pressure from a source of compressed air and positioned in an interior of the housing;

a connection port inlet configured for connection to the source of compressed air and positioned on a side portion of the housing; and a connection port outlet configured for connection with a compressed-air inlet of the spray gun and positioned on another side portion of the housing, the connection port outlet admitting pressure-regulated air into the spray gun during cleaning of the spray gun wherein the control device further comprises a selection switch for switching the cleaning device between a cleaning function and a spraying function, wherein in the spraying function the full air pressure of the compressed air is applied through the connection port outlet into the compressed-air inlet of the spray gun and in the cleaning function the air pressure of the compressed air applied into the compressed-air inlet of the spray gun is reduced by the pressure regulator.

18. A method for cleaning a spray gun with the cleaning device of claim 1, the method comprising the steps of:

connecting the connection port inlet of the control device to a source of compressed air;

connecting the connection port outlet of the control device with a compressed-air inlet of the spray gun;

switching the pressure regulator to a function, in which the pressure regulator reduces the air pressure of the compressed air applied to the connection port inlet to a lower value so the air pressure of the pressurized air applied to the compressed-air inlet of the spray gun is lower than the air pressure of the source of compressed air;

supplying a cleaning fluid to the spray gun by a feed device having an input connectable to a reservoir of cleaning fluid, and an output connected to at least one cleaning nozzle which is spraying the cleaning fluid into or onto the spray gun; and manually cleaning the spray gun or at least a part of the spray gun by a friction cleaning device located proximate the cleaning nozzle while the cleaning nozzle is spraying cleaning fluid to the spray gun.

* * * * *